US007985269B2

(12) United States Patent
Ludwig

(10) Patent No.: US 7,985,269 B2
(45) Date of Patent: Jul. 26, 2011

(54) NONWOVEN ABRASIVE ARTICLES AND METHODS OF MAKING THE SAME

(75) Inventor: Bret W. Ludwig, Oakdale, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 738 days.

(21) Appl. No.: 11/566,426

(22) Filed: Dec. 4, 2006

(65) Prior Publication Data

US 2008/0127572 A1 Jun. 5, 2008

(51) Int. Cl.

| | |
|---|---|
| ***B24D 3/00*** | (2006.01) |
| ***B24D 11/00*** | (2006.01) |
| ***B24D 18/00*** | (2006.01) |
| ***B24D 3/02*** | (2006.01) |
| ***C09K 3/14*** | (2006.01) |
| ***C09C 1/68*** | (2006.01) |

(52) U.S. Cl. ..... 51/298; 51/293; 51/299; 51/307

(58) Field of Classification Search ..... 51/298, 51/299, 307, 293

See application file for complete search history.

(56) References Cited

U.S. PATENT DOCUMENTS

| | | | | |
|---|---|---|---|---|
| 2,958,593 | A | 11/1960 | Hoover et al. | |
| 4,374,237 | A | 2/1983 | Berger et al. | |
| 4,609,380 | A | 9/1986 | Barnett et al. | |
| 4,773,920 | A | 9/1988 | Chasman et al. | |
| 5,250,085 | A | 10/1993 | Mevissen | |
| 5,373,047 | A | 12/1994 | Schnelle et al. | |
| 5,378,252 | A | 1/1995 | Follensbee | |
| 5,391,210 | A | 2/1995 | Bilkadi et al. | |
| 5,405,648 | A | 4/1995 | Hermann | |
| 5,591,239 | A | 1/1997 | Larson et al. | |
| 5,641,330 | A | 6/1997 | Celikkaya et al. | |
| 5,669,940 | A | 9/1997 | Stubbs | |
| 6,017,831 | A | 1/2000 | Beardsley et al. | |
| 6,165,239 | A | 12/2000 | Hedrick et al. | |
| 6,302,930 | B1 | 10/2001 | Lux | |
| 6,475,253 | B2 | 11/2002 | Culler et al. | |
| 6,620,214 | B2 | 9/2003 | McArdle et al. | |
| 6,733,876 | B1 | 5/2004 | Beardsley et al. | |
| 6,786,801 | B2 * | 9/2004 | Mann | 451/28 |
| 6,949,128 | B2 | 9/2005 | Annen | |
| 7,044,835 | B2 | 5/2006 | Mujumdar et al. | |
| 2003/0005646 | A1 | 1/2003 | McHale, Jr. | |
| 2003/0192258 | A1 | 10/2003 | Simon | |
| 2004/0098923 | A1 | 5/2004 | Hood et al. | |
| 2004/0101680 | A1 * | 5/2004 | Barber, Jr. | 428/360 |
| 2004/0118051 | A1 * | 6/2004 | Shiho et al. | 51/295 |
| 2005/0113005 | A1 | 5/2005 | Woo et al. | |
| 2006/0041065 | A1 | 2/2006 | Barber, Jr. | |

FOREIGN PATENT DOCUMENTS

| | | |
|---|---|---|
| EP | 0 780 421 A2 | 6/1997 |
| JP | 56-014435 | 2/1981 |
| JP | 62-152679 | 7/1987 |
| WO | WO 94/11318 | 5/1994 |
| WO | WO 98/51981 | 11/1998 |

* cited by examiner

*Primary Examiner* — Jerry Lorengo
(74) *Attorney, Agent, or Firm* — Bradford B. Wright

(57) ABSTRACT

Lofty open nonwoven abrasive articles, unitized abrasive wheels, and convolute abrasive wheels include a dipodal aminosilane. Methods of making the abrasive articles are also included.

9 Claims, 1 Drawing Sheet

NONWOVEN ABRASIVE ARTICLES AND METHODS OF MAKING THE SAME

BACKGROUND

Nonwoven abrasive articles generally have a nonwoven fiber web (e.g., a lofty open fiber web), abrasive particles, and a binder material (commonly termed a "binder") that bonds the fibers to each other and secures the abrasive particles to the fiber web. Examples of nonwoven abrasive articles include nonwoven abrasive hand pads such as those marketed by 3M Company of Saint Paul, Minn. under the trade designation "SCOTCH-BRITE". Other examples of abrasive articles include convolute abrasive wheels and unitary abrasive wheels. Nonwoven abrasive wheels typically have abrasive particles distributed through layers of nonwoven fiber web bonded together with a binder material that bonds layers of nonwoven fiber web together, and likewise bonds the abrasive particles to the nonwoven fiber web. For example, unitary abrasive wheels have individual discs of nonwoven fiber web arranged in a parallel fashion to form a cylinder having a hollow axial core. Alternatively, convolute abrasive wheels have nonwoven fiber web spirally disposed and affixed to a core member.

SUMMARY

In one aspect, the present invention provides a lofty open nonwoven abrasive article comprising:

a lofty open nonwoven fiber web;
abrasive particles; and
a polyurethane binder binding the abrasive particles to the nonwoven fiber web, wherein the polyurethane binder comprises:
at least one of a cationic surfactant, anionic surfactant, fluorinated nonionic surfactant, or silicone-based nonionic surfactant; and
a reaction product of components comprising:
a curable urethane prepolymer;
an amine curative; and
a dipodal aminosilane represented by the formula $$(RO)_3Si—Z—(NH—Z')_n—Z—Si(OR)_3$$

wherein
each R independently represents an alkyl or aryl group;
each Z independently represents an alkylene group having from 1 to 4 carbon atoms;
each Z' independently represents a covalent bond or an alkylene group having from 1 to 4 carbon atoms, with the proviso that no more than one Z' represents a covalent bond; and
n is 1, 2 or 3.

In another aspect, the present invention provides a method of making a lofty open nonwoven abrasive article, the method comprising:

providing a lofty open nonwoven fiber web;
impregnating the nonwoven fiber web with a curable composition comprising: abrasive particles;
a curable urethane prepolymer;
an effective amount of an amine curative;
at least one of a cationic surfactant, anionic surfactant, fluorinated nonionic surfactant, or silicone-based nonionic surfactant; and
a dipodal aminosilane represented by the formula $$(RO)_3Si—Z—(NH—Z')_n—Z—Si(OR)_3$$

wherein
each R independently represents an alkyl or aryl group;
each Z independently represents an alkylene group having from 1 to 4 carbon atoms;
each Z' independently represents a covalent bond or an alkylene group having from 1 to 4 carbon atoms, with the proviso that no more than one Z' represents a covalent bond; and
n is 1, 2 or 3; and curing the curable urethane prepolymer to provide the nonwoven abrasive article.

In another aspect, the present invention provides a convolute abrasive wheel comprising:

a core member having an outer surface;
a convolute nonwoven abrasive affixed to the outer surface of the core member, the convolute nonwoven abrasive comprising:
layered nonwoven fiber web spirally disposed around and affixed to the core member;
abrasive particles; and
a polyurethane binder binding the abrasive particles to the layered nonwoven fiber web and binding layers of the layered nonwoven fiber web to each other, wherein the polyurethane binder comprises:
at least one of a cationic surfactant, anionic surfactant, fluorinated nonionic surfactant, or silicone-based nonionic surfactant; and
a reaction product of components comprising:
a curable urethane prepolymer;
an amine curative; and
a dipodal aminosilane represented by the formula $$(RO)_3Si—Z—(NH—Z')_n—Z—Si(OR)_3$$

wherein
each R independently represents an alkyl or aryl group;
each Z independently represents an alkylene group having from 1 to 4 carbon atoms;
each Z' independently represents a covalent bond or an alkylene group having from 1 to 4 carbon atoms, with the proviso that no more than one Z' represents a covalent bond; and
n is 1, 2 or 3.

In another aspect, the present invention provides a method of making a convolute abrasive wheel, the method comprising:

impregnating a fiber web with a curable composition comprising:
curable polyurethane prepolymer;
abrasive particles;
an effective amount of an amine curative;
at least one of a cationic surfactant, anionic surfactant, fluorinated nonionic surfactant, or silicone-based nonionic surfactant; and
a dipodal aminosilane, wherein the dipodal aminosilane is represented by the formula:

$$(RO)_3Si—Z—(NH—Z')_n—Z—Si(OR)_3$$

and wherein
each R independently represents an alkyl or aryl group;
each Z independently represents an alkylene group having from 1 to 4 carbon atoms;

each Z' independently represents a covalent bond or an alkylene group having from 1 to 4 carbon atoms, with the proviso that no more than one Z' represents a covalent bond; and n is 1, 2 or 3; and spirally winding the impregnated fiber web around a core member to form a curable preform;

curing the curable preform to provide the convolute abrasive wheel.

In another aspect, the present invention provides a unitized abrasive wheel comprising:

discs of nonwoven fiber web forming a cylinder having a hollow axial core;

abrasive particles; and a polyurethane binder binding the abrasive particles to the layers of nonwoven fiber web and binding the layers of nonwoven fiber web to each other, wherein the polyurethane binder comprises:

at least one of a cationic surfactant, anionic surfactant, fluorinated nonionic surfactant, or silicone-based nonionic surfactant; and a reaction product of components comprising:

a curable urethane prepolymer;

an amine curative; and a dipodal aminosilane represented by the formula $$(RO)_3Si—Z—(NH—Z')_n—Z—Si(OR)_3$$

wherein each R independently represents an alkyl or aryl group;

each Z independently represents an alkylene group having from 1 to 4 carbon atoms;

each Z' independently represents a covalent bond or an alkylene group having from 1 to 4 carbon atoms, with the proviso that no more than one Z' represents a covalent bond; and n is 1, 2 or 3.

In another aspect, the present invention provides a method of making a unitized abrasive wheel having a hollow axial core, the method comprising:

providing layers of nonwoven fiber web impregnated with a curable composition comprising:

curable polyurethane prepolymer;

abrasive particles;

an effective amount of an amine curative;

at least one of a cationic surfactant, anionic surfactant, fluorinated nonionic surfactant, or silicone-based nonionic surfactant; and a dipodal aminosilane, wherein the dipodal aminosilane is represented by the formula:

$$(RO)_3Si—Z—(NH—Z')_n—Z—Si(OR)_3$$

and wherein each R independently represents an alkyl or aryl group;

each Z independently represents an alkylene group having from 1 to 4 carbon atoms;

each Z' independently represents a covalent bond or an alkylene group having from 1 to 4 carbon atoms, with the proviso that no more than one Z' represents a covalent bond; and n is 1, 2 or 3; and compressing the layers of nonwoven fiber web impregnated with the curable composition to provide a curable preform;

curing the curable preform to provide a cured preform; and forming the cured preform into the unitary abrasive wheel.

In the aforementioned abrasive articles, and methods for their making, the nonwoven fiber web may have a pre-bond resin thereon.

In the aforementioned abrasive articles, and methods for their making, the dipodal aminosilane may be selected from the group consisting of bis[(3-trimethoxysilyl)propyl]-ethylenediamine, bis(trimethoxysilylpropyl)amine, and bis(triethoxysilylpropyl)amine.

It is surprisingly found that nonwoven abrasive articles according to the present invention exhibit significant improvement in the cut/wear ratio, as evaluated according to the test methods presented herein, if compared to corresponding prior art nonwoven abrasive articles as in the Examples hereinbelow.

As used herein:

The term "amine curative" refers to an amine that is effective for crosslinking the curable polyurethane prepolymer. The amine curative is typically used in an "effective amount", that is, an amount sufficient to cure the curable composition.

The term "cure" means providing a sufficient degree of chain extension of the curable polyurethane prepolymer that the resulting article is suitable for use as an abrasive article.

DETAILED DESCRIPTION

Figure 1A:
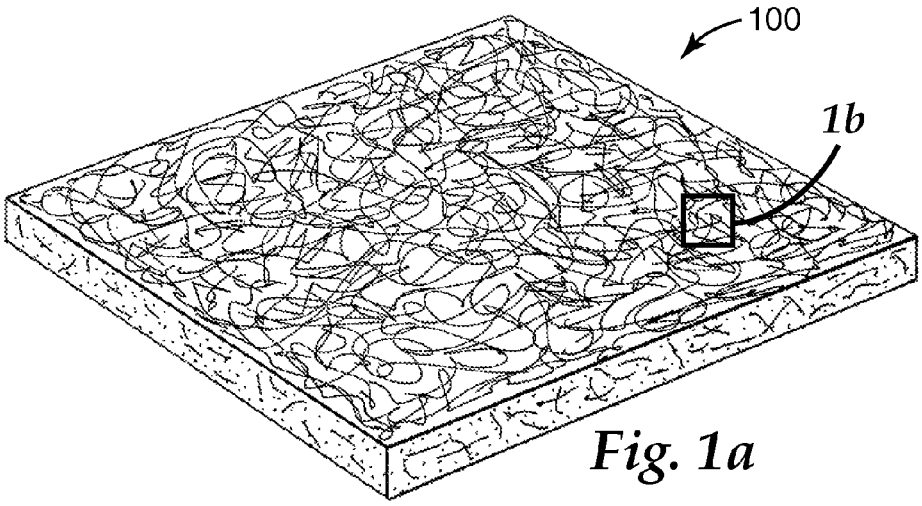
FIG. 1A is a perspective view of an exemplary nonwoven abrasive article according to the present invention.

Various exemplary abrasive articles according to the present invention, including lofty open nonwoven abrasive articles (e.g., webs and sheets), unitized abrasive wheels, and convolute abrasive wheels, may be manufactured through processes that include common steps such as, for example, coating a curable composition, typically in slurry form, on a nonwoven fiber web. The curable composition comprises: a curable polyurethane prepolymer; an effective amount of an amine curative; at least one of a cationic surfactant, anionic surfactant, fluorinated nonionic surfactant, or silicone-based nonionic surfactant; and a dipodal aminosilane. In the formation of convolute or unitized abrasive wheels, the nonwoven fiber web is typically compressed (i.e., densified) relative to nonwoven fiber webs used in lofty open nonwoven fiber articles.

Nonwoven fiber webs suitable for use in the aforementioned abrasive articles are well known in the abrasives art. Typically, the nonwoven fiber web comprises an entangled web of fibers. The fibers may comprise continuous fiber, staple fiber, or a combination thereof. For example, the fiber web may comprise staple fibers having a length of at least about 20 millimeters (mm), at least about 30 mm, or at least about 40 mm, and less than about 110 mm, less than about 85 mm, or less than about 65 mm, although shorter and longer fibers (e.g., continuous filaments) may also be useful. The fibers may have a fineness or linear density of at least about 1.7 decitex (dtex, i.e., grams/10000 meters), at least about 6 dtex, or at least about 17 dtex, and less than about 560 dtex, less than about 280 dtex, or less than about 120 dtex, although fibers having lesser and/or greater linear densities may also be useful. Mixtures of fibers with differing linear densities may be useful, for example, to provide an abrasive article that upon use will result in a specifically preferred surface finish. If a spunbond nonwoven is used, the filaments may be of substantially larger diameter, for example, up to 2 mm or more in diameter.

The fiber web may be made, for example, by conventional air laid, carded, stitch bonded, spun bonded, wet laid, and/or melt blown procedures. Air laid fiber webs may be prepared using equipment such as, for example, that available under the trade designation "RANDO WEBBER" commercially available from Rando Machine Company of Macedon, N.Y.

Nonwoven fiber webs are typically selected to be suitably compatible with adhering binders and abrasive particles while also being processable in combination with other components of the article, and typically can withstand processing conditions (e.g., temperatures) such as those employed during application and curing of the curable composition. The fibers may be chosen to affect properties of the abrasive article such as, for example, flexibility, elasticity, durability or longevity, abrasiveness, and finishing properties. Examples of fibers that may be suitable include natural fibers, synthetic fibers, and mixtures of natural and/or synthetic fibers. Examples of synthetic fibers include those made from polyester (e.g., polyethylene terephthalate), nylon (e.g., hexamethylene adipamide, polycaprolactam), polypropylene, acrylonitrile (i.e., acrylic), rayon, cellulose acetate, polyvinylidene chloride-vinyl chloride copolymers, and vinyl chloride-acrylonitrile copolymers. Examples of suitable natural fibers include cotton, wool, jute, and hemp. The fiber may be of virgin material or of recycled or waste material, for example, reclaimed from garment cuttings, carpet manufacturing, fiber manufacturing, or textile processing. The fiber may be homogenous or a composite such as a bicomponent fiber (e.g., a co-spun sheath-core fiber). The fibers may be tensilized and crimped, but may also be continuous filaments such as those formed by an extrusion process. Combinations of fibers may also be used.

Prior to impregnation with the curable composition, the nonwoven fiber web typically has a weight per unit area (i.e., basis weight) of at least about 50 grams per square meter (gsm), at least about 100 gsm, or at least about 200 gsm; and/or less than about 400 gsm, less than about 350 gsm, or less than about 300 gsm, as measured prior to any coating (e.g., with the curable composition or optional pre-bond resin), although greater and lesser basis weights may also be used. In addition, prior to impregnation with the curable composition, the fiber web typically has a thickness of at least about 5 mm, at least about 6 mm, or at least about 10 mm; and/or less than about 200 mm, less than about 75 mm, or less than about 30 mm, although greater and lesser thicknesses may also be useful.

Further details concerning nonwoven abrasive articles, abrasive wheels and methods for their manufacture may be found, for example, in U.S. Pat. No. 2,958,593 (Hoover et al.); U.S. Pat. No. 5,591,239 (Larson et al.); U.S. Pat. No. 6,017,831 (Beardsley et al.); and U.S. Pat. Appln. Publ. 2006/0041065 A 1 (Barber, Jr.), the disclosures of which are hereby incorporated herein by reference.

Frequently, as known in the abrasive art, it is useful to apply a pre-bond resin to the nonwoven fiber web prior to coating with the curable composition. The pre-bond resin serves, for example, to help maintain the nonwoven fiber web integrity during handling, and may also facilitate bonding of the urethane binder to the nonwoven fiber web. Examples of prebond resins include phenolic resins, urethane resins, hide glue, acrylic resins, urea-formaldehyde resins, melamine-formaldehyde resins, epoxy resins, and combinations thereof. The amount of pre-bond resin used in this manner is typically adjusted toward the minimum amount consistent with bonding the fibers together at their points of crossing contact. In those cases, wherein the nonwoven fiber web includes thermally bondable fibers, thermal bonding of the nonwoven fiber web may also be helpful to maintain web integrity during processing.

Examples of useful abrasive particles include any abrasive particles known in the abrasive art. Exemplary useful abrasive particles include fused aluminum oxide based materials such as aluminum oxide, ceramic aluminum oxide (which may include one or more metal oxide modifiers and/or seeding or nucleating agents), and heat-treated aluminum oxide, silicon carbide, co-fused alumina-zirconia, diamond, ceria, titanium diboride, cubic boron nitride, boron carbide, garnet, flint, emery, sol-gel derived abrasive particles, and mixtures thereof. The abrasive particles may be in the form of, for example, individual particles, agglomerates, composite particles, and mixtures thereof.

The abrasive particles may, for example, have an average diameter of at least about 0.1 micrometer, at least about 1 micrometer, or at least about 10 micrometers, and less than about 2000, less than about 1300 micrometers, or less than about 1000 micrometers, although larger and smaller abrasive particles may also be used. For example, the abrasive particles may have an abrasives industry specified nominal grade. Such abrasives industry accepted grading standards include those known as the American National Standards Institute, Inc. (ANSI) standards, Federation of European Producers of Abrasive Products (FEPA) standards, and Japanese Industrial Standard (JIS) standards. Exemplary ANSI grade designations (i.e., specified nominal grades) include: ANSI 4, ANSI 6, ANSI 8, ANSI 16, ANSI 24, ANSI 36, ANSI 40, ANSI 50, ANSI 60, ANSI 80, ANSI 100, ANSI 120, ANSI 150, ANSI 180, ANSI 220, ANSI 240, ANSI 280, ANSI 320, ANSI 360, ANSI 400, and ANSI 600. Exemplary FEPA grade designations include P8, P12, P16, P24, P36, P40, P50, P60, P80, P100, P120, P150, P180, P220, P320, P400, P500, 600, P800, P1000, and P1200. Exemplary JIS grade designations include HS8, JIS12, JIS16, JIS24, JIS36, JIS46, JIS54, JIS60, JIS80, JIS100, JIS150, JIS180, JIS220, JIS240, JIS280, JIS320, JIS360, JIS400, JIS400, JIS600, JIS800, JIS1000, JIS1500, JIS2500, JIS4000, JIS6000, JIS8000, and JIS10000.

Typically, the coating weight for the abrasive particles (independent of other ingredients in the curable composition) may depend, for example, on the particular curable urethane prepolymer used, the process for applying the abrasive particles, and the size of the abrasive particles. For example, the coating weight of the abrasive particles on the nonwoven fiber web (before any compression) may be at least 200 grams per square meter (g/m), at least 600 g/m, or at least 800 g/m; and/or less than 2000 g/m, less than about 1600 g/m, or less than about 1200 g/m, although greater or lesser coating weights may be also be used.

Examples of useful urethane prepolymers include polyisocyanates and blocked versions thereof. Typically, blocked polyisocyanates are substantially unreactive to isocyanate reactive compounds (e.g., amines, alcohols, thiols, etc.) under ambient conditions (e.g., temperatures in a range of from about 20° C. to about 25° C.), but upon application of sufficient thermal energy the blocking agent is released, thereby generating isocyanate functionality that reacts with the amine curative to form a covalent bond.

Useful polyisocyanates include, for example, aliphatic polyisocyanates (e.g., hexamethylene diisocyanate or trimethylhexamethylene diisocyanate); alicyclic polyisocyanates (e.g., hydrogenated xylylene diisocyanate or isophorone diisocyanate); aromatic polyisocyanates (e.g., tolylene diisocyanate or 4,4'-diphenylmethane diisocyanate); adducts of any of the foregoing polyisocyanates with a polyhydric alcohol (e.g., a diol, low molecular weight hydroxyl group-containing polyester resin, water, etc.); adducts of the foregoing polyisocyanates (e.g., isocyanurates, biurets); and mixtures thereof.

Useful commercially available polyisocyanates include, for example, those available under the trade designation "ADIPRENE" from Chemtura Corporation, Middlebury, Conn. (e.g., "ADIPRENE L 0311", "ADIPRENE L 100", "ADIPRENE L 167", "ADIPRENE L 213", "ADIPRENE L 315", "ADIPRENE L 680", "ADIPRENE LF 1800A", "ADIPRENE LF 600D", "ADIPRENE LFP 1950A", "ADIPRENE LFP 2950A", "ADIPRENE LFP 590D", "ADIPRENE LW 520", and "ADIPRENE PP 1095"); polyisocyanates available under the trade designation "MONDUR" from Bayer Corporation, Pittsburgh, Pa. (e.g., "MONDUR 1437", "MONDUR MP-095", or "MONDUR 448"); and polyisocyanates available under the trade designations "AIRTHANE" and "VERSATHANE" from Air Products and Chemicals, Allentown, Pa. (e.g., "AIRTHANE APC-504", "AIRTHANE PST-95A", "AIRTHANE PST-85A", "AIRTHANE PET-91A", "AIRTHANE PET-75D", "VERSATHANE STE-95A", "VERSATHANE STE-P95", "VERSATHANE STS-55", "VERSATHANE SME-90A", and "VERSATHANE MS-90A").

To lengthen pot-life, polyisocyanates such as, for example, those mentioned above may be blocked with a blocking agent according to various techniques known in the art. Exemplary blocking agents include ketoximes (e.g., 2-butanone oxime); lactams (e.g., epsilon-caprolactam); malonic esters (e.g., dimethyl malonate and diethyl malonate); pyrazoles (e.g., 3,5-dimethylpyrazole); alcohols including tertiary alcohols (e.g., t-butanol or 2,2-dimethylpentanol), phenols (e.g., alkylated phenols), and mixtures of alcohols as described.

Exemplary useful commercially available blocked polyisocyanates include those marketed by Chemtura Corporation under the trade designations "ADIPRENE BL 11", "ADIPRENE BL 16", "ADIPRENE BL 31", and blocked polyisocyanates marketed by Baxenden Chemicals, Ltd., Accrington, England under the trade designation "TRIXENE" (e.g., "TRIXENE BL 7641", "TRIXENE BL 7642", "TRIXENE BL 7772", and "TRIXENE BL 7774").

Typically, the amount of urethane prepolymer present in the curable composition is in an amount of from 10 to 40 percent by weight, more typically in an amount of from 15 to 30 percent by weight, and even more typically in an amount of from 20 to 25 percent by weight based on the total weight of the curable composition, although amounts outside of these ranges may also be used.

Suitable amine curatives include aromatic, alkyl-aromatic, or alkyl polyfunctional amines, preferably primary amines. Examples of useful amine curatives include 4,4'-methylenedianiline; polymeric methylene dianilines having a functionality of 2.1 to 4.0 which include those known under the trade designations "CURITHANE 103", commercially available from the Dow Chemical Company, and "MDA-85" from Bayer Corporation, Pittsburgh, Pa.; 1,5-diamine-2-methylpentane; tris(2-aminoethyl) amine; 3-aminomethyl-3,5,5-trimethylcyclohexylamine (i.e., isophoronediamine), trimethylene glycol di-p-aminobenzoate, bis(o-aminophenylthio) ethane, 4,4'-methylenebis(dimethyl anthranilate), bis(4-amino-3-ethylphenyl)methane (e.g., as marketed under the trade designation "KAYAHARD AA" by Nippon Kayaku Company, Ltd., Tokyo, Japan), and bis(4-amino-3,5-diethylphenyl)methane (e.g., as marketed under the trade designation "LONZACURE M-DEA" by Lonza, Ltd., Basel, Switzerland), and mixtures thereof. If desired, polyol(s) may be added to the curable composition, for example, to modify (e.g., to retard) cure rates as required by the intended use.

The amine curative should be present in an amount effective (i.e., an effective amount) to cure the blocked polyisocyanate to the degree required by the intended application; for example, the amine curative may be present in a stoichiometric ratio of curative to isocyanate (or blocked isocyanate) in a range of from 0.8 to 1.35; for example, in a range of from 0.85 to 1.20, or in a range of from 0.90 to 0.95, although stoichiometric ratios outside these ranges may also be used.

Useful dipodal aminosilanes are represented by the formula:

$$(RO)_3Si—Z—(NH—Z')_n—Z—Si(OR)_3$$

Each R independently represents an alkyl group (e.g., an alkyl group having from 1 to 6 carbon atoms) or an aryl group (e.g., phenyl). The alkyl groups may be branched, cyclic, or linear.

Each Z independently represents an alkylene group having from 1 to 4 carbon atoms (e.g., methyl, ethyl, isopropyl, or t-butyl).

Each Z' independently represents a covalent bond or an alkylene group having from 1 to 4 carbon atoms (e.g., methylene, ethylene, propylene, butylene), with the proviso that no more than one Z' represents a covalent bond.

n is 1, 2 or 3.

Examples of useful commercially available dipodal aminosilanes include bis[(3-trimethoxysilyl)propyl]ethylenediamine, bis(3-triethoxysilylpropyl)amine, and bis(trimethoxysilylpropyl)amine.

Typically, the dipodal aminosilane is included in the curable composition in an amount of from 0.05-0.75 percent by weight, more typically, in an amount of from 0.15 to 0.4 percent by weight, and even more typically in an amount of from 0.2-0.3 percent by weight, based on the total weight of the curable composition, although amounts outside these ranges may also be used.

Examples of useful anionic surfactants include alkali metal and (alkyl)ammonium salts of: 1) alkyl sulfates and sulfonates such as sodium dodecyl sulfate and potassium dodecanesulfonate; 2) sulfates of polyethoxylated derivatives of straight or branched chain aliphatic alcohols and carboxylic acids; 3) alkylbenzene or alkylnaphthalene sulfonates and sulfates such as sodium laurylbenzenesulfonate; 4) ethoxylated and polyethoxylated alkyl and aralkyl alcohol carboxylates; 5) glycinates such as alkyl sarcosinates and alkyl glycinates; 6) sulfosuccinates including dialkyl sulfosuccinates; and 7) N-acyltaurine derivatives such as sodium N-methyl-N-oleyltaurate).

Examples of useful cationic surfactants include alkylammonium salts having the formula $C_yH_{2y+1}N(CH_3)_3X$, where X is OH, Cl, Br, HSO4 or a combination of OH and Cl, and where y is an integer from 8 to 22, and the formula $C_qH_{2q+1}N(C_2H_5)_3X$, where q is an integer from 12 to 18; gemini surfactants, for example those having the formula: $[C_{16}H_{33}N(CH_3)_2C_mH_{2m+1}]X$, wherein m is an integer from 2 to 12 and X is as defined above; aralkylammonium salts such as, for example, benzalkonium salts; and cetylethylpiperidinium salts, for example, $C_{16}H_{33}N(C_2H_5)(C_5H_{10})X$, wherein X is as defined above. One useful commercially available cationic surfactant is 1-propanamine, 3-(isodecyloxy)-, acetate, CAS No. 28701-67-9, available under the trade designation "PA-14 ACETATE" from Tomah Products, Milton, Wis.

Examples of fluorinated nonionic surfactants include those fluorinated non-ionic surfactants available under the trade designations "3M NOVEC FLUOROSURFACTANT FC-4430" and "3M NOVEC FLUOROSURFACTANT FC-4432" from 3M Company, St. Paul, Minn.

Examples of silicone-based nonionic surfactants include those having polysiloxane segments and polyalkyleneoxy segments such as for example, a polyether-modified methyl polysiloxane marketed under the trade designation "BAYSILONE PAINT ADDITIVE 3739" by Lanxess Corporation, Pittsburgh, Pa.

Typically, the surfactant(s) is/are included in the curable composition in an amount of from 0.01-0.4 percent by weight, more typically, in an amount of from 0.02 to 0.2 percent by weight, and even more typically in an amount of from 0.05-0.1 percent by weight, based on the total weight of the curable composition, although amounts outside these ranges may also be used.

Typically, the curable composition will include at least one organic solvent (e.g., isopropyl alcohol or methyl ethyl ketone) to facilitate coating of the curable composition on the nonwoven fiber web, although this is not a requirement.

Optionally, the curable composition may be mixed with and/or include one or more additives. Exemplary additives include fillers, plasticizers, surfactants, lubricants, colorants (e.g., pigments), bactericides, fungicides, grinding aids, and antistatic agents.

In one exemplary method of making nonwoven abrasive articles according to the present invention there are the steps of, in this sequence, applying a prebond coating to the nonwoven fiber web (e.g., by roll-coating or spray coating), curing the prebond coating, impregnating the nonwoven fiber web with the curable composition (e.g., by roll-coating or spray coating), and curing the curable composition.

Typically, the curable composition (including any solvent that may be present) is coated onto the nonwoven fiber web in an amount of from 1120 to 2080 gsm, more typically 1280-1920 gsm, and even more typically 1440-1760 gsm, although values outside these ranges may also be used.

Figure 1B:
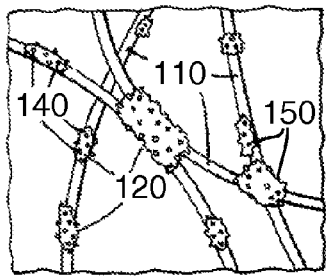
FIG. 1B is an enlarged view of a region of the nonwoven abrasive article shown in FIG. 1A.

Abrasive articles according to the present invention include, for example, lofty open nonwoven abrasive articles which may be provided as continuous web or in converted forms such as sheets (e.g., disks or hand pads). An exemplary embodiment of a nonwoven abrasive article according to the present invention is shown in FIGS. 1A and 1B, wherein lofty open low-density fibrous web 100 is formed of entangled filaments 110 held together by polyurethane binder 120. Abrasive particles 140 are dispersed throughout fibrous web 100 on exposed surfaces of filaments 110. Polyurethane binder 120 coats portions of filaments 110 and forms globules 150 which may encircle individual filaments or bundles of filaments, adhere to the surface of the filament and/or collect at the intersection of contacting filaments, providing abrasive sites throughout the nonwoven abrasive article.

Figure 2:
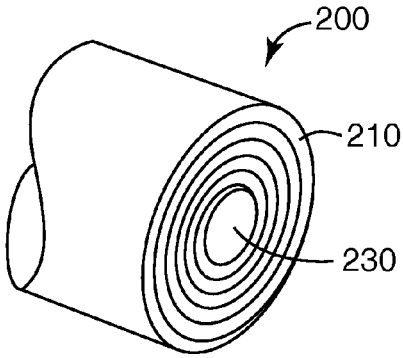
FIG. 2, is a perspective schematic view of an exemplary convolute abrasive wheel according to one aspect of the present invention.

Convolute abrasive wheels may be provided, for example, by winding the nonwoven fiber web that has been impregnated with the curable composition under tension around a core member (e.g., a tubular or rod-shaped core member) such that the impregnated nonwoven fiber layers become compressed, and then curing the curable composition to provide a polyurethane binder binding the abrasive particles to the layered nonwoven fiber web and binding layers of the layered nonwoven fiber web to each other. An exemplary convolute abrasive wheel 200 is shown in FIG. 2, wherein layered nonwoven fiber web 210, coated with polyurethane binder binding the abrasive particles to the layered nonwoven fiber web and binding layers of the layered nonwoven fiber web to each other is spirally disposed around and affixed to core member 230. If desired, convolute abrasive wheels may be dressed prior to use to remove surface irregularities, for example, using methods known in the abrasive arts.

Figure 3:
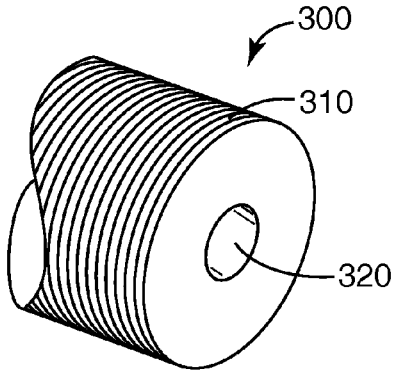
FIG. 3 is a perspective schematic view of an exemplary unitized abrasive wheel according to one aspect of the present invention.

Referring now to FIG. 3, unitized abrasive wheels can be provided, for example, by layering the impregnated above-provided nonwoven fiber web (e.g., as a layered continuous web or as a stack of sheets) compressing the nonwoven fiber layers 310, curing the curable composition (e.g., using heat), and die cutting the resultant abrasive article to provide a unitized abrasive wheel 300 having a hollow axial core 320.

In compressing the layers of impregnated nonwoven fiber web, the layers are typically compressed to form a bun having a density that is from 1 to 20 times that of the density of the layers in their non-compressed state. The bun is then typically subjected to heat molding (e.g., for from 2 to 20 hours) at elevated temperature (e.g., at 135° C.), typically depending on the urethane prepolymer and bun size.

Objects and advantages of this invention are further illustrated by the following non-limiting examples, but the particular materials and amounts thereof recited in these examples, as well as other conditions and, details, should not be construed to unduly limit this invention.

EXAMPLES

Unless otherwise noted, all parts, percentages, ratios, etc. in the examples and the rest of the specification are by weight.

The following abbreviations are used throughout the Examples.

| | |
|---|---|
| A1100 | gamma-aminopropyltriethoxysilane available under the trade designation "SILQUEST A-1100 SILANE" from GE Silicones, Friendly, West Virginia |
| A1170 | bis(trimethoxysilylpropyl)amine available under the trade designation "SILQUEST A-1170 SILANE" from GE Silicones |
| A15 | N-ethyl-3-trimethoxysilyl-2-methylpropanamine available under the trade designation "SILQUEST A-LINK 15 ™ SILANE" from GE Silicones |
| AF | silicone antifoam available under the trade designation "DOW CORNING ANTIFOAM 1520 - US" from Dow Corning Corp., Midland, Michigan |
| B3739 | A polyether-modified methyl polysiloxane available under the trade designation "BAYSILONE PAINT ADDITIVE 3739" from Lanxess Corporation, Pittsburgh, Pennsylvania |

-continued

| | |
|---|---|
| BL16 | urethane prepolymer available under the trade designation "ADIPRENE BL16" from Chemtura Corporation, Middlebury, Connecticut |
| CARBEZ3 | rheology modifier available under the trade designation "CARBOPOL EZ-3 POLYMER" from Noveon, Inc., Cleveland, Ohio |
| CARBEZ3S | 5 weight percent solution of CARBEZ3 in water |
| D1122 | bis(triethoxysilylpropyl)amine available under the trade designation "DYNASYLAN 1122" from Degussa North America, Parsippany, New Jersey |
| EP1 | epoxy resin available under the trade designation "EPI-REZ 3510-W-60" from Resolution Performance Products, Houston, Texas |
| FC4430 | fluorosurfactant available under the trade designation "3M NOVEC FLUOROSURFACTANT FC-4430" from 3M Company, St. Paul, Minnesota |
| FC4430S | 25 weight percent solution of FC4430 in IPA |
| GR5 | bis(2-ethylhexyl) sulfosuccinate sodium salt available under the trade designation "TRITON GR-5" from Rohm and Haas, Philadelphia, Pennsylvania |
| IPA | isopropyl alcohol |
| LCD4115 | carbon black dispersion available under the trade designation "LCD-4115 SPECIALTY CARBON BLACK DISPERSION" from Sun Chemical Corporation, Amelia, Ohio |
| LiSt | lithium stearate |
| LiStS | 44.7 weight percent solution of lithium stearate available under the trade designation "LITHIUMSOAP 1" from Baerlocher, Cincinnati, Ohio, in PMA |
| M353 | talc available under the trade designation "MISTRON 353" from Luzenac America, Centennial, Colorado |
| MDA | 4,4'-methylenedianiline available from Aceto Corporation, Lake Success, New York |
| MDAS | 34.2 weight percent solution of 4,4'-methylenedianiline in PMA |
| MDAS2 | 33 weight percent solution of 4,4'-methylenedianiline in PMA |
| PA14 | cationic surfactant, 1-propanamine, 3-(isodecyloxy)-, acetate, CAS No. 28701-67-9, available under the trade designation "PA-14 ACETATE" from Tomah Products, Milton, Wisconsin |
| PHEN1 | 25 weight percent solution of phenoxy resin in PMA available under the trade designation "INCHEMREZ PKHS 25M Solution of Phenoxy Resin" from InChem, Naperville, Illinois |
| PMA | propylene glycol methyl ether acetate available under the trade designation "DOWANOL PMA" from the DOW Chemical Company, Midland, Michigan |
| SIB1817.0 | bis(triethoxysilyl)ethane available under the trade designation "SIB1817.0" from Gelest, Inc., Morrisville, Pennsylvania |
| SIB1824.0 | bis(triethoxysilyl)octane available under the trade designation "SIB1824.0" from Gelest, Inc. |
| SIB1824.6 | bis[3-(triethoxysilyl)propyl]disulfide available under the trade designation "SIB1824.6" from Gelest, Inc. |
| SIB1829.0 | 1,2-bis(trimethoxysilyl)decane available under the trade designation "SIB1829.0" from Gelest, Inc. |
| SIB1831.0 | 1,4-bis(trimethoxysilylethyl)benzene available under the trade designation "SIB1831.0" from Gelest, Inc. |
| SIB1834.0 | bis[(3-trimethoxysilyl)propyl]ethylenediamine, 62% in methanol available under the trade designation "SIB1834.0" from Gelest, Inc. |
| SiC | 1 part to 1 part, by weight, blend of 150 and 180 grit silicon carbide abrasive particles available under the trade designation "SILCARIDE 21, SILICON CARBIDE GRADE 150/180", from Washington Mills Electro Minerals Group, Niagara Falls, New York |
| SIL1 | fumed silica available under the trade designation "AEROSIL R 202 VV60" from Degussa North America |
| T403 | polyetheramine available under the trade designation "JEFFAMINE T-403 POLYETHERAMINE" from Huntsman International LLC, Salt Lake City, Utah |
| T403LiSt | mixture of 66.7 weight percent T403 and 33.3 weight percent LiSt |
| T403S | 25 weight percent solution of T403 in water |
| T60 | nonionic polyoxyethylene sorbitan monostearate, available under the trade designation "TWEEN 60" from Uniqema, New Castle, Delaware |

Preparation of Pre-Mix 1

A pre-mix consisting of 20 g of PMA, 100 g of LiStS, 145 g of PHEN1, and 100 g of M353 was prepared using an air powered, high shear mixer with the speed adjusted to generate a strong vortex in the pre-mix while mixing. In some instances (indicated in Tables 1, 3 and 5) small amounts of additional PMA were added to Pre-Mix 1.

Preparation of Pre-Mix 2

A pre-mix consisting of 35 g of PMA, 132 g of LiStS, 190 g of PHEN1, 132 g of M353 and 0.65 g of SIL1 was prepared using an air powered, high shear mixer with the speed adjusted to generate a strong vortex in the pre-mix while mixing.

Abrasive Slurry Preparation

Abrasive slurries were prepared in approximately 300-400 g batches using an air powered, high shear mixer with the speed adjusted to generate a strong vortex in the slurry while mixing. The component order of addition was that as the sequence listed in Tables 1, 3, 5, 7, 9 and 11 (top to bottom). After the final component was added, mixing was continued for one minute.

Unitized Abrasive Wheel Preparation

A nonwoven web was formed on an air laid fiber web forming machine, available under the trade designation "RANDO-WEBBER" from the Rando Machine Corporation of Macedon, N.Y. The fiber web was formed from 15 denier nylon crimp set fiber with a staple length of one and one-half inches (trade designation "T852" available from E. I. du Pont de Nemours & Company, Wilmington, Del.). The weight of the web was approximately 126 grams per square meter (gsm), and the thickness was approximately 0.4 inches (10 mm). The web was conveyed to a horizontal, two-roll coater, where a pre-bond resin was applied at a wet add-on weight of 192 gsm. The pre-bond resin had the following composition (all percentages relative to component weight): 47.5% tap water, 26.4% T403S, 17.6% EP1, 0.5% AF, 1% LCD4115, 2.8% T403LiSt, 4.2% CARBEZ3S. The pre-bond resin was cured to a non-tacky condition by passing the coated web through a convection oven at 338° F. (170° C.) for 7 minutes, yielding a pre-bonded, nonwoven web of approximately 7 mm thickness and having a basis weight of 176 gsm.

Unitized abrasive wheels were prepared from the pre-bonded nonwoven web as follows. A 9-inch (23-cm)×11-inch (28-cm) section was cut from the pre-bonded, nonwoven web and saturated with abrasive slurry. The saturated pre-bonded web was then passed through the nip of a roll coater consisting of 4-inch (10-cm) diameter rubber rolls of 85-Shore A durometer hardness, to remove excess slurry until the desired slurry add-on weight of 3.53±0.35 oz (100±1 g) was obtained. Typically, multiple passes through the nip at 11 fpm (3.35 mpm) under pressures of 10-25 psi (69-172 kPa) were required to reach the target weight. Two sections of pre-bonded web were coated with the slurry in the above manner. The coated sections of pre-bonded web were placed in a forced air oven set at 260° F. (127° C.) for 1 minute to remove a majority of the solvent. In order to form a single, unitized slab of nonwoven, abrasive material, the two sections were then stacked one on top of the other and placed in a hydraulic, heated platen press set at 260° F. (127° C.). A release liner was placed on both sides of the stack, prior to placing it in the oven. Consistent thickness of the unitized slab was maintained by placing 0.25 inch (0.635 cm) thick metal spacers in each corner of the platen. Pressure (5,000 psi, 34.5 MPa), was applied to the platens. After 30 minutes, the two sections of web had fused together into a single, unitized slab. This slab was placed in a forced air oven set at 260° F. (127° C.) for 90 minutes. After removal from the oven, the slab was cooled to room temperature, and a 8.0-inch (20-cm) diameter unitized abrasive wheel with a 1.25-inch (3.2-cm) center hole was die cut from it using a SAMCO SB-25 swing beam press manufactured by Deutsche Vereinigte Schuhmaschinen GmbH & Co., Frankfurt, Germany.

Convolute Abrasive Wheel Preparation

A nonwoven web was formed on an air laid fiber web forming machine, available under the trade designation "RANDO-WEBBER" from the Rando Machine Corporation of Macedon, N.Y. The fiber web was formed from 15 denier nylon crimp set fiber with a staple length of one and one-half inches (trade designation "T852" available from E. I. du Pont de Nemours & Company, Wilmington, Del.). The weight of the web was approximately 126 gsm and the thickness was approximately 0.4 inch (10 mm). The web was conveyed to a horizontal, two-roll coater, where a pre-bond resin was applied at a wet add-on weight of 192 gsm. The pre-bond resin had the following composition (all percentages relative to component weight): 55.5% PMA, 6.71% MDAS2, 20.9% BL16, 12.4% PHEN1, 4.45% LiStS. The pre-bond resin was cured to a non-tacky condition by passing the coated web through a convection oven at 320° F. (160° C.) for 7 minutes, yielding a pre-bonded, nonwoven web approximately 7 mm thick and having a basis weight of 176 gsm.

A strip of pre-bonded, nonwoven web, 1.125 inches (2.9 cm) in width and 10.5 feet (3.2 meters) in length, weighing approximately 16 grams was saturated with abrasive slurry. Excess slurry was removed by running the saturated, pre-bonded web through the nip of a roll coater, as described in the Unitized Abrasive Wheel Preparation procedure (above). Nip pressures were adjusted in the range of 5 to 10 psi (34 to 69 kPa) and 130 g of slurry remained coated on the web after processing. The slurry-impregnated pre-bonded web was then placed in a 260° F. (127° C.) oven for one minute to remove a majority of the solvent.

The slurry coated, pre-bonded web was then wrapped around the circumference of an 8-inch (20-cm) diameter 8S FIN EXL wheel with a 3-inch (7.6-cm) center hole available from the 3M Company. Tension was applied to the coated nonwoven web during the winding, causing the 1.125-inch (2.86-cm) strip to narrow to the one inch (2.54 cm) width of the base wheel. Following winding, the pre-bonded web was held in place by circumferentially wrapping it with a release liner, secured with a subsequent wrapping of tape. The wheel was cured in a forced air oven at 260° F. (127° C.) for 3 hours. After curing, the tape and release liner were removed to provide a convolute wheel.

Nonwoven Abrasive Sheet Preparation

A nonwoven abrasive sheet was prepared from a single layer of pre-bonded, nonwoven web. The same pre-bonded web as described in the Convolute Wheel Preparation method was used for abrasive sheets. A 9-inch×11-inch (22.9-cm×27.9-cm) sheet of pre-bonded, nonwoven web was saturated with slurry. Excess slurry was removed by running the saturated, pre-bonded web through the nip of a roll coater, as described in the Unitized Abrasive Wheel Preparation procedure (above), leaving approximately 92 g of slurry. The slurry impregnated web was dried and cured in a forced air oven at 260° F. (127° C.) for two hours.

Unitized Abrasive Wheel Test

A pre-weighed, unitized abrasive wheel to be tested was mounted on the arbor of a mechanically driven, variable speed lathe operating at 50 revolutions per minute. A carriage containing a pre-weighed 2 inches×11 inches (5.1 cm×27.9 cm) perforated, carbon steel coupon cut from a perforated plate, part number F5000401, from Harrington and King Perforating Company, Chicago, Ill., was brought horizontally against the rotating wheel's face. A 4-lb (1.8-kg) load was applied to the carriage, urging the coupon into the rotating wheel. The carriage was oscillated tangentially up and down with a stroke length of 5 inches (130 mm) and a stroke speed of 2.6 inches (6.6 cm) per second. A test cycle consisted of contacting the rotating wheel and perforated plate for 15 seconds under load and then removing the wheel from contact with the plate for 15 seconds. A test sequence consisted of 10 test cycles. After the test sequence was complete, the wheel and coupon were reweighed. The amount of material removed from the coupon during the test sequence was designated as the "cut" and was defined as the difference between the weight of the coupon before and after the test sequence. The amount of material removed from the wheel during the test sequence was designated as the "wear" and was defined as the difference between the weight of the wheel before and after the test sequence. The test sequence was then repeated twice more on the same wheel. Results from the second and third sequences were reported, as the first sequence is considered to be dressing of the wheel.

Convolute Abrasive Wheel Test

A convolute abrasive wheel to be tested was mounted on the arbor of a Hammond Variable Speed Polishing and Buffing Lathe from Hammond Machinery Builders; Kalamazoo, Mich. Prior to testing, the wheel was dressed by manually contacting the edge of a 0.0625 inch (0.159 cm) thick by 9 inches (22.9 cm) long carbon steel coupon into the wheel's one inch (2.54 cm) thick face for approximately two minutes at a load of 30 lbs (13.6 kg) while the wheel rotated at a frequency of 1700 revolutions per minute. The wheel was removed from the arbor, weighed, and remounted on the arbor. The test was conducted at a wheel rotation frequency of 1700 revolutions per minute. The test consisted of manually urging the edge of a pre-weighed, 0.0625 inch (0.159 cm) thick by 9 inches (22.9 cm) long aluminum coupon into the wheel's one inch thick face with approximately 30 lbs (13.6 kg) of applied load for twenty seconds. After the 20-second test was completed, the wheel and the aluminum coupon were reweighed. From the differences in the pre-abrasion and post-abrasion wheel and coupon weights, the wheel's cut and wear performance were then determined as described in the Unitized Abrasive Wheel Test (first test). The test was then repeated on the same wheel (second test). Results from each test were reported.

Nonwoven Abrasive Sheet Test

A pre-weighed 1.5 inch×9 inches (3.8 cm×22.9 cm) piece of nonwoven abrasive sheet to be tested was adhered to a 2 inches×11 inches (5.1 cm×27.9 cm) aluminum plate using an epoxy adhesive that was cured at 180° F. (82° C.) for one hour. Care was taken to insure that the epoxy did not leach through to the front side of the abrasive sheet. The piece of nonwoven abrasive sheet was then tested using the same apparatus and general procedure described in the Unitized Abrasive Wheel Test section (above) with the following modifications. The aluminum plate, with attached abrasive sheet, was mounted in the carriage of the apparatus. Two, pre-weighed, 7-inch (18-cm) diameter wheels cut from 0.645 inch (1.58 cm) thick 304 stainless steel with 1.25 inch (3.2 cm) diameter center holes were ganged on the arbor, creating a 1.29 inch (3.28 cm) wide contact region. The stainless steel wheels had four, 0.25 inch (0.64 cm) wide by 1 inch (2.54 cm) deep, notches cut across their 0.645 inch (0.164 cm) thick face. The notches were spaced 90 degrees about the circumference of each wheel. The notches of the two wheels were aligned upon mounting. A 12-lb (5.4-kg) load was applied to the carriage, urging the abrasive sheet into the rotating wheels. After the test sequence was complete, the wheels and coupon were reweighed and the cut, wear and cut/wear ratio determined, as previously defined. Upon completion of the initial test sequence, the test sequence was repeated up to four more times. In each additional test sequence, the sample and wheels were weighed before and after testing to obtain the cut, wear and cut/wear ratio, as previously defined. Results of the individual test sequences were reported.

Examples 1 and 2 and Comparative Examples A-E

Unitized abrasive wheels were prepared according to the procedures set forth above in the sections Abrasive Slurry Preparation and Unitized Abrasive Wheel Preparation, using the ingredients and amounts reported in Table 1. The unitized abrasive wheels were tested according to the Unitized Abrasive Wheel Test. Results are reported in Table 2.

TABLE 1

| | Parts by Weight | | | | | | |
|---|---|---|---|---|---|---|---|
| Component | Example 1 | Example 2 | Comparative Example A | Comparative Example B | Comparative Example C | Comparative Example D | Comparative Example E |
| BL16 | 71.8 | 71.8 | 71.8 | 71.8 | 71.8 | 71.8 | 71.8 |
| MDAS | 24.8 | 24.8 | 25.8 | 25.8 | 24.2 | 24.2 | 24.8 |
| Pre-Mix 1 | 73 | 73 | 73 | 73 | 73 | 73 | 73 |
| PMA added to the 73 g of Pre-Mix 1 | 0 | 0 | 0.5 | 0.5 | 1.0 | 1.0 | 0 |
| SiC | 136 | 136 | 136 | 136 | 136 | 136 | 136 |
| A1100 | 0 | 0 | 0 | 0 | 1.23 | 0 | 0 |
| A15 | 0 | 0 | 0 | 0 | 0 | 1.23 | 0 |
| A1170 | 1.23 | 1.23 | 0 | 0 | 0 | 0 | 1.23 |
| B3739 | 0.60 | 0 | 0 | 0 | 0 | 0 | 0 |
| FC4430S | 0 | 0.60 | 0 | 0.6 | 0 | 0 | 0 |

TABLE 2

| Parameter | Test Sequence | Example 1 | Example 2 | Comparative Example A | Comparative Example B | Comparative Example C | Comparative Example D | Comparative Example E |
|---|---|---|---|---|---|---|---|---|
| Cut, grams | 2 | 0.67 | 0.74 | 0.38 | 0.31 | 0.50 | 0.68 | 0.76 |
| | 3 | 0.72 | 0.80 | 0.43 | 0.30 | 0.63 | 0.80 | 0.76 |

TABLE 2-continued

| Parameter | Test Sequence | Example 1 | Example 2 | Comparative Example A | Comparative Example B | Comparative Example C | Comparative Example D | Comparative Example E |
|---|---|---|---|---|---|---|---|---|
| Wear, grams | 2 | 0.06 | 0.06 | 0.15 | 0.26 | 0.08 | 0.09 | 0.10 |
| | 3 | 0.06 | 0.08 | 0.31 | 0.28 | 0.10 | 0.16 | 0.14 |
| Cut/Wear | 2 | 11.17 | 12.33 | 2.53 | 1.19 | 6.25 | 7.56 | 7.60 |
| | 3 | 12.00 | 10.00 | 1.39 | 1.07 | 6.30 | 5.00 | 5.43 |

Example 3 and Comparative Examples F-L

Unitized abrasive wheels were prepared according to the procedures set forth above in the sections Abrasive Slurry Preparation and Unitized Abrasive Wheel Preparation, using the ingredients and amounts reported in Table 3. The unitized abrasive wheels were tested according to the Unitized Abrasive Wheel Test. Results are reported in Table 4.

TABLE 3

| | Parts by Weight | | | | | | | |
|---|---|---|---|---|---|---|---|---|
| Component | Example 3 | Comparative Example F | Comparative Example G | Comparative Example H | Comparative Example I | Comparative Example J | Comparative Example K | Comparative Example L |
| BL16 | 71.8 | 71.8 | 71.8 | 71.8 | 94.8 | 94.8 | 94.8 | 94.8 |
| MDAS | 25.3 | 25.0 | 25.0 | 25.3 | 32.7 | 31.4 | 32.7 | 31.4 |
| Pre-Mix 1 | 73 | 73 | 73 | 73 | 0 | 0 | 0 | 0 |
| PMA added to the 73 g of Pre-Mix 1 | 1.0 | 1.0 | 1.0 | 1.0 | 0 | 0 | 0 | 0 |
| Pre-Mix 2 | 0 | 0 | 0 | 0 | 97.9 | 97.9 | 97.9 | 97.9 |
| SiC | 136 | 136 | 136 | 136 | 179 | 179 | 179 | 179 |
| A1100 | 0 | 0.6 | 0.6 | 0 | 0 | 0 | 0 | 0 |
| A1170 | 0.6 | 0 | 0 | 0.6 | 0 | 0 | 0 | 0 |
| A15 | 0 | 0 | 0 | 0 | 0.9 | 0.9 | 1.9 | 1.9 |
| FC4430S | 0.6 | 0 | 0.6 | 0 | 0 | 0.26 | 0 | 0.26 |

TABLE 4

| Parameter | Test Sequence | Example 3 | Comp. Example F | Comp. Example G | Comp. Example H | Comp. Example I | Comp. Example J | Comp. Example K | Comp. Example L |
|---|---|---|---|---|---|---|---|---|---|
| Cut, grams | 2 | 1.32 | 1.19 | 1.05 | 1.12 | 0.48 | 0.56 | 0.50 | 0.57 |
| | 3 | 1.01 | 1.07 | 1.09 | 1.17 | 0.41 | 0.51 | 0.54 | 0.54 |
| Wear, grams | 2 | 0.14 | 0.17 | 0.32 | 0.21 | 0.08 | 0.11 | 0.10 | 0.14 |
| | 3 | 0.10 | 0.23 | 0.34 | 0.22 | 0.07 | 0.09 | 0.12 | 0.14 |
| Cut/wear | 2 | 9.43 | 7.00 | 3.28 | 4.41 | 6.00 | 5.09 | 5.00 | 4.07 |
| | 3 | 10.10 | 4.65 | 3.21 | 5.33 | 5.86 | 5.67 | 4.50 | 3.86 |

TABLE 5

| | Parts by Weight | | | | | |
|---|---|---|---|---|---|---|
| Component | Example 4 | Example 5 | Example 6 | Comparative Example M | Comparative Example N | Comparative Example O |
| BL16 | 94.8 | 94.8 | 94.8 | 94.8 | 94.8 | 94.8 |
| Pre-Mix 2 | 97.9 | 97.9 | 97.9 | 97.9 | 97.9 | 97.9 |
| MDAS | 33.7 | 33.7 | 33.7 | 33.9 | 33.7 | 33.7 |
| SiC | 179 | 179 | 179 | 179 | 179 | 179 |
| D1122 | 0.76 | 0.76 | 0.76 | 0 | 0.76 | 0.76 |
| FC4430S | 0.18 | 0 | 0 | 0 | 0 | 0 |
| GR5 | 0 | 0.36 | 0 | 0 | 0 | 0 |
| T60 | 0 | 0 | 0 | 0 | 0 | 0.36 |
| PA14 | 0 | 0 | 0.36 | 0 | 0 | 0 |

Examples 4-6 and Comparative Examples M-O

Unitized abrasive wheels were prepared according to the procedures set forth above in the sections Abrasive Slurry Preparation and Unitized Abrasive Wheel Preparation, using the ingredients and amounts reported in Table 5. The unitized abrasive wheels were tested according to the Unitized Abrasive Wheel Test. Results are reported in Table 6.

TABLE 6

| Parameter | Test Sequence | Example 4 | Example 5 | Example 6 | Comparative Example M | Comparative Example N | Comparative Example O |
|---|---|---|---|---|---|---|---|
| Cut, grams | 2 | 0.45 | 0.41 | 0.52 | 0.31 | 0.45 | 0.46 |
| | 3 | 0.42 | 0.44 | 0.40 | 0.31 | 0.43 | 0.44 |
| Wear, grams | 2 | 0.10 | 0.09 | 0.12 | 0.23 | 0.12 | 0.14 |
| | 3 | 0.10 | 0.11 | 0.08 | 0.28 | 0.10 | 0.11 |
| Cut/wear | 2 | 4.50 | 4.56 | 4.33 | 1.35 | 3.75 | 3.29 |
| | 3 | 4.20 | 4.00 | 5.00 | 1.11 | 4.30 | 4.00 |

Examples 7 and 8 and Comparative Examples P-T

Unitized abrasive wheels were prepared according to the procedures set forth above in the sections Abrasive Slurry Preparation and Unitized Abrasive Wheel Preparation, using the ingredients and amounts reported in Table 7. The unitized abrasive wheels were tested according to the Unitized Abrasive Wheel Test. Results are reported in Table 8.

TABLE 7

| | Parts by Weight | | | | | | |
|---|---|---|---|---|---|---|---|
| Components | Example 7 | Example 8 | Comparative Example P | Comparative Example Q | Comparative Example R | Comparative Example S | Comparative Example T |
| BL16 | 94.8 | 94.8 | 94.8 | 94.8 | 94.8 | 94.8 | 94.8 |
| Pre-mix 2 | 97.9 | 97.9 | 97.9 | 97.9 | 97.9 | 97.9 | 97.9 |
| MDAS | 33.7 | 33.4 | 33.9 | 33.9 | 33.9 | 33.9 | 33.9 |
| SiC | 179 | 179 | 179 | 179 | 179 | 179 | 179 |
| D1122 | 0.76 | 0 | 0 | 0 | 0 | 0 | 0 |
| SIB1834.0 | 0 | 0.69 | 0 | 0 | 0 | 0 | 0 |
| SIB1824.6 | 0 | 0 | 0.85 | 0 | 0 | 0 | 0 |
| SIB1817.0 | 0 | 0 | 0 | 0.63 | 0 | 0 | 0 |
| SIB1824.0 | 0 | 0 | 0 | 0 | 0.78 | 0 | 0 |
| SIB1831.0 | 0 | 0 | 0 | 0 | 0 | 0.67 | 0 |
| SIB1829.0 | 0 | 0 | 0 | 0 | 0 | 0 | 0.68 |
| FC4430S | 0.18 | 0.18 | 0.18 | 0.18 | 0.18 | 0.18 | 0.18 |

TABLE 8

| Parameter | Test Sequence | Example 7 | Example 8 | Comparative Example P | Comparative Example Q | Comparative Example R | Comparative Example S | Comparative Example T |
|---|---|---|---|---|---|---|---|---|
| Cut, grams | 2 | 0.47 | 0.43 | 0.32 | 0.30 | 0.27 | 0.31 | 0.27 |
| | 3 | 0.40 | 0.43 | 0.25 | 0.31 | 0.27 | 0.30 | 0.30 |
| Wear, grams | 2 | 0.15 | 0.09 | 0.23 | 0.15 | 0.31 | 0.17 | 0.27 |
| | 3 | 0.11 | 0.11 | 0.16 | 0.19 | 0.32 | 0.18 | 0.24 |
| Cut/wear | 2 | 3.13 | 4.78 | 1.39 | 2.00 | 0.87 | 1.82 | 1.00 |
| | 3 | 3.64 | 3.91 | 1.56 | 1.63 | 0.84 | 1.67 | 1.25 |

Example 9 and Comparative Examples U and V

Convolute abrasive wheels were prepared according to the procedures set forth above in the sections Abrasive Slurry Preparation and Convolute Abrasive Wheel Preparation, using the ingredients and amounts reported in Table 9 (below).

TABLE 9

| | Parts by Weight | | |
|---|---|---|---|
| Components | Example 9 | Comparative Example U | Comparative Example V |
| BL16 | 94.8 | 94.8 | 94.8 |
| Pre-mix 2 | 97.9 | 97.9 | 97.9 |
| MDAS | 33.7 | 33.7 | 33.7 |
| SiC | 179 | 179 | 179 |
| A1100 | 0 | 0 | 0.80 |
| D1122 | 0.76 | 0 | 0 |
| FC4430S | 0.18 | 0 | 0.18 |

The convolute abrasive wheels were tested according to the Convolute Abrasive Wheel Test. Results are reported in Table 10 (below).

TABLE 10

| Parameter | Test | Example 9 | Comparative Example U | Comparative Example V |
|---|---|---|---|---|
| Cut, grams | 1 | 1.49 | 1.40 | 1.82 |
| | 2 | 1.60 | 1.40 | 1.76 |
| Wear, grams | 1 | 2.00 | 7.30 | 8.30 |
| | 2 | 2.00 | 5.80 | 8.00 |
| Cut/wear | 1 | 0.75 | 0.19 | 0.22 |
| | 2 | 0.80 | 0.24 | 0.22 |

Example 10 and Comparative Examples W and X

Nonwoven abrasive sheets were prepared according to the procedures set forth above in the sections Abrasive Slurry Preparation and Nonwoven Abrasive Sheet Preparation, using the ingredients and amounts reported in Table 11 (below).

TABLE 11

| | Parts by Weight | | |
|---|---|---|---|
| Components | Example 10 | Comparative Example W | Comparative Example X |
| BL16 | 94.8 | 94.8 | 94.8 |
| Pre-mix 2 | 97.9 | 97.9 | 97.9 |
| MDAS | 33.7 | 33.7 | 33.7 |
| SiC | 179 | 179 | 179 |
| A1100 | 0 | 0 | 0.80 |
| D1122 | 0.76 | 0 | 0 |
| FC4430S | 0.18 | 0 | 0.18 |

The nonwoven abrasive sheets were tested according to the Nonwoven Abrasive Sheet Test. Results are reported in Table 12 (below) wherein "NM" means "not measured".

TABLE 12

| Parameter | Test Sequence | Example 10 | Comparative Example W | Comparative Example X |
|---|---|---|---|---|
| Cut, grams | 1 | 0.08 | 0.13 | 0.08 |
| | 2 | 0.07 | 0.07 | 0.08 |
| | 3 | 0.08 | 0.04 | 0.04 |
| | 4 | 0.08 | NM | NM |
| | 5 | 0.10 | NM | NM |
| Wear, grams | 1 | 0.02 | 0.21 | 0.04 |
| | 2 | 0.01 | 0.06 | 0.03 |
| | 3 | 0.01 | 0.05 | 0.01 |
| | 4 | 0.01 | NM | NM |
| | 5 | 0.01 | NM | NM |
| Cut/wear | 1 | 4.0 | 0.6 | 2.0 |
| | 2 | 7.0 | 1.2 | 2.7 |
| | 3 | 8.0 | 0.8 | 4.0 |
| | 4 | 8.0 | NM | NM |
| | 5 | 10.0 | NM | NM |

Various modifications and alterations of this invention may be made by those skilled in the art without departing from the scope and spirit of this invention, and it should be understood that this invention is not to be unduly limited to the illustrative embodiments set forth herein.

What is claimed is:

1. A lofty open nonwoven abrasive article comprising:

a lofty open nonwoven fiber web;

abrasive particles; and a polyurethane binder binding the abrasive particles to the nonwoven fiber web, wherein the polyurethane binder comprises:

at least one of a cationic surfactant, anionic surfactant, fluorinated nonionic surfactant, or silicone-based nonionic surfactant; and a reaction product of components comprising:

a curable urethane prepolymer;

an amine curative; and a dipodal aminosilane represented by the formula $$(RO)_3Si—Z—(NH—Z')_n—Z—Si(OR)_3$$

wherein each R independently represents an alkyl or aryl group;

each Z independently represents an alkylene group having from 1 to 4 carbon atoms;

each Z' independently represents a covalent bond or an alkylene group having from 1 to 4 carbon atoms, with the proviso that no more than one Z' represents a covalent bond; and n is 1, 2 or 3.

2. The nonwoven abrasive article of claim 1, wherein the nonwoven fiber web has a pre-bond resin thereon.

3. The nonwoven abrasive article of claim 1, wherein the dipodal aminosilane is selected from the group consisting of bis[(3-trimethoxysilyl)propyl]ethylenediamine, bis(trimethoxysilylpropyl)amine, and bis(triethoxysilylpropyl)amine.

4. A convolute abrasive wheel comprising:

a core member having an outer surface;

a convolute nonwoven abrasive affixed to the outer surface of the core member, the convolute nonwoven abrasive comprising:

layered nonwoven fiber web spirally disposed around and affixed to the core member;

abrasive particles; and a polyurethane binder binding the abrasive particles to the layered nonwoven fiber web and binding layers of the layered nonwoven fiber web to each other, wherein the polyurethane binder comprises:

at least one of a cationic surfactant, anionic surfactant, fluorinated nonionic surfactant, or silicone-based nonionic surfactant; and a reaction product of components comprising:

a curable urethane prepolymer;

an amine curative; and a dipodal aminosilane represented by the formula $$(RO)_3Si—Z—(NH—Z')_n—Z—Si(OR)_3$$

wherein each R independently represents an alkyl or aryl group;

each Z independently represents an alkylene group having from 1 to 4 carbon atoms;

each Z' independently represents a covalent bond or an alkylene group having from 1 to 4 carbon atoms, with the proviso that no more than one Z' represents a covalent bond; and n is 1, 2 or 3.

5. The convolute abrasive wheel of claim 4, wherein the nonwoven fiber web has a pre-bond resin thereon.

6. The convolute abrasive wheel of claim 4, wherein the dipodal aminosilane is selected from the group consisting of bis[(3-trimethoxysilyl)propyl]ethylenediamine, bis(trimethoxysilylpropyl)amine, and bis(triethoxysilylpropyl)amine.

7. A unitized abrasive wheel comprising:

discs of nonwoven fiber web forming a cylinder having a hollow axial core;

abrasive particles; and a polyurethane binder binding the abrasive particles to the discs of nonwoven fiber web and binding the discs of nonwoven fiber web to each other, wherein the polyurethane binder comprises:

at least one of a cationic surfactant, anionic surfactant, fluorinated nonionic surfactant, or silicone-based nonionic surfactant; and a reaction product of components comprising:

a curable urethane prepolymer;

an amine curative; and a dipodal aminosilane represented by the formula $$(RO)_3Si—Z—(NH—Z')_n—Z—Si(OR)_3$$

wherein each R independently represents an alkyl or aryl group;

each Z independently represents an alkylene group having from 1 to 4 carbon atoms;

each Z' independently represents a covalent bond or an alkylene group having from 1 to 4 carbon atoms, with the proviso that no more than one Z' represents a covalent bond; and n is 1, 2 or 3.

8. The unitized abrasive wheel of claim 7, wherein the nonwoven fiber web has a pre-bond resin thereon.

9. The unitized abrasive wheel of claim 7, wherein the dipodal aminosilane is selected from the group consisting of bis[(3-trimethoxysilyl)propyl]ethylenediamine, bis(trimethoxysilylpropyl)amine, and bis(triethoxysilylpropyl)amine.

* * * * *